US007037030B2

(12) United States Patent
McLemore

(10) Patent No.: US 7,037,030 B2
(45) Date of Patent: May 2, 2006

(54) PROJECT 'M'—VEHICULAR INSPECTION RIGI-FRAME AND CRASH BEAM

(76) Inventor: Keith Steven McLemore, 2104 W. Foster, Chicago, IL (US) 60625

( * ) Notice: Subject to any disclaimer, the term of this patent is extended or adjusted under 35 U.S.C. 154(b) by 0 days.

(21) Appl. No.: 10/891,822

(22) Filed: Jul. 16, 2004

(65) Prior Publication Data

US 2006/0054875 A1 Mar. 16, 2006

(51) Int. Cl.
*E01F 13/00* (2006.01)
*E04H 9/10* (2006.01)
*E04H 9/04* (2006.01)

(52) U.S. Cl. ..... 404/6; 52/653.1; 52/653.2

(58) Field of Classification Search ..... 404/6, 404/1; 52/783.17, 202, 79.14, 653.1, 653.2
See application file for complete search history.

(56) References Cited

U.S. PATENT DOCUMENTS 3,146,349 A * 8/1964 Jordan ..... 376/160
4,313,708 A * 2/1982 Tiliakos ..... 414/498
5,668,342 A * 9/1997 Discher ..... 86/50
5,838,758 A * 11/1998 Krug et al. ..... 378/53
6,062,765 A * 5/2000 Dotson ..... 404/6
6,094,472 A * 7/2000 Smith ..... 378/86
6,112,931 A * 9/2000 Booth et al. ..... 220/88.1
6,354,181 B1 * 3/2002 Donovan ..... 86/50
6,418,189 B1 * 7/2002 Schafer ..... 378/57
6,542,580 B1 * 4/2003 Carver et al. ..... 378/57
6,611,210 B1 * 8/2003 Hilliard et al. ..... 340/941
2002/0232054 * 11/2004 Brown et al. ..... 209/552
2004/0232054 A1 * 11/2004 Brown et al. ..... 209/552

FOREIGN PATENT DOCUMENTS

FR 0399124 A1 * 11/1990

* cited by examiner

*Primary Examiner*—Raymond W. Addie

(57) ABSTRACT

A rigid frame inspection structure ("Rigi-Frame") and method for housing radiation, contagion, explosive, and other forms of detection and surveillance equipment, while providing crash beams that form horizontal fixed obstacles with the ability to impede vehicles approaching at a high velocity. The crash beams force small passenger vehicles and larger trucks to conform to the inspection station procedure.

18 Claims, 10 Drawing Sheets

PROJECT 'M'—VEHICULAR INSPECTION RIGI-FRAME AND CRASH BEAM

FIELD OF INVENTION

The present invention relates to a structure and method for housing radiation, contagion, explosive, and other forms of detection and surveillance equipment, while providing for a means to impede vehicles approaching at a high velocity.

BACKGROUND AND DESCRIPTION OF THE RELATED ART

Vehicles containing explosives have increasingly been used by terrorists as a tool of choice in carrying out their mission to disrupt society, inflict mass casualties, and cause maximum property damage. An example of such a terrorist attack include a rental truck which was packed with explosives, caused mass casualties and extensive property damage to the underground parking facility of the World Trade Center complex in New York (Feb. 1993).

To modern Western society, global terrorism is a relatively new phenomenon with consequences that warrant innovative methods of accurately determining and isolating threats. To date, there is no infrastructure in the prior art broadly established in any North American or European city to routinely obstruct or inspect vehicles carrying bombs. The only disclosed method of stopping vehicles containing bombs involves chance interception of a terrorist group's intentions by Homeland Security or other coordinated federal or local governmental investigative units. Given the fact that vehicular bombs are among the most efficient tools for inflicting mass causalities and property damage by terrorists, there must be a simplified and standardized method, with structure, to thwart terrorist events.

SUMMARY OF THE INVENTION

The present invention provides a rigid frame inspection structure ("Rigi-Frame") and method for housing radiation, contagion, explosive, and other forms of detection and surveillance equipment, while providing crash beams that form horizontal fixed obstacles so that small passenger vehicles and larger trucks must conform to the inspection station procedure.

OBJECTIVES AND ADVANTAGES OF THE INVENTION

It is the object of the present invention to provide a rigid frame inspection structure for housing radiation, contagion, explosive, and other forms of detection and surveillance equipment, while providing horizontal fixed obstacles so that small passenger vehicles and larger trucks must conform to the inspection station procedure.

Another objective is to provide a crash beam structure to impede fast moving vehicles attempting to avoid inspection.

Another objective is to provide the rigid frame inspection structure and crash beams in a kit form to allow for rapid deployment and assembly.

Another objective is to provide an inexpensive rigid frame inspection structure and crash beams in a modular kit form.

Another objective is to provide the rigid frame inspection structure and crash beams in a kit that allows for replacement of damaged parts.

Another objective is to provide a crash beam with a horizontal barrier elevated to a particular height to allow smaller vehicles to pass underneath, while impeding larger vehicles typically used in terrorist attacks.

Another objective is to provide a crash beams with horizontal barriers to protect the structural integrity of the rigid frame inspection structure and its vital contents.

Another objective is to employ the rigid frame inspection structure and crash beams to assist in the protection of sensitive locations including government buildings, critical campuses, and central business districts.

These, and other, objectives and advantages of the invention will become more apparent as this description proceeds, taken in conjunction with the accompanying drawings.

DETAILED DESCRIPTION OF THE PREFERRED EMBODIMENTS

Figure 1:
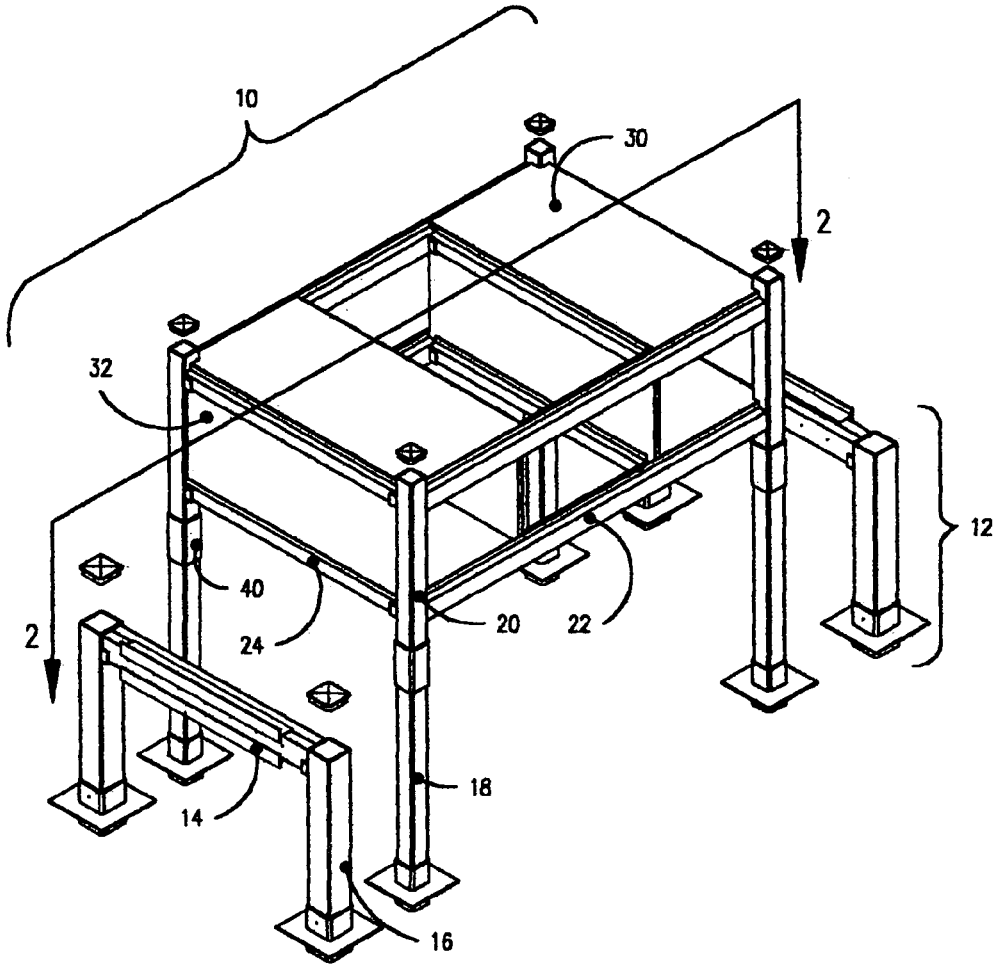
FIG. 1 is a perspective view of the rigid frame inspection structure with crash beams at points of entry and exit.

With reference to the accompanying drawings and particularly FIGS. 1, 2, 3, and 4 a rigid frame inspection structure 10 ("Rigi-Frame") and method for housing radiation, contagion, explosive, and other forms of detection and surveillance equipment (not shown), while providing horizontal fixed obstacles or crash beam structures 12 so that small passenger vehicles and larger trucks must conform to the inspection station procedure are illustrated. The height of the horizontal member 14 of the crash beam structure is set to allow clearance for vehicles having a profile below a specified maximum. For example, vehicles can be segregated during inspection between passenger cars (low profile) and trucks, or other large vehicles that can be denied entry to a facility.

The rigid frame inspection structure 10 consists of a series of lower vertical members 18, upper vertical members 20, horizontal support members 22, and horizontal cross members 24. The members (18, 20, 22, 24) are of an elongated tubular square or rectangular design, and are made of metal or other high strength composite material. The lower vertical members 18 form the legs of the rigid frame inspection structure 10. The upper vertical members 20 define the height of the area for the inspection equipment (not shown). The entire rigid frame inspection structure 10 is designed to support the combined load of the detection equipment, human service men, and environmental loads such as wind, water, ice, and snow.

Figure 2:
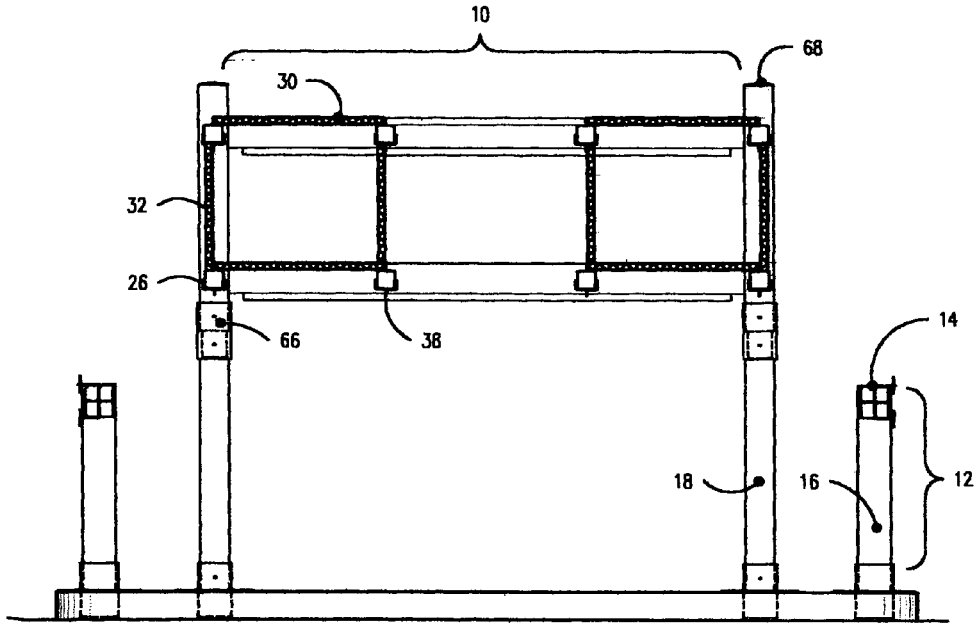
FIG. 2 is a sectional side view of the rigid frame inspection structure with crash beams at the points of entry and exit a long line 2—2 of FIG. 1, and also shows a concrete curb retaining structure (not shown in FIG. 1).
Figure 4A:
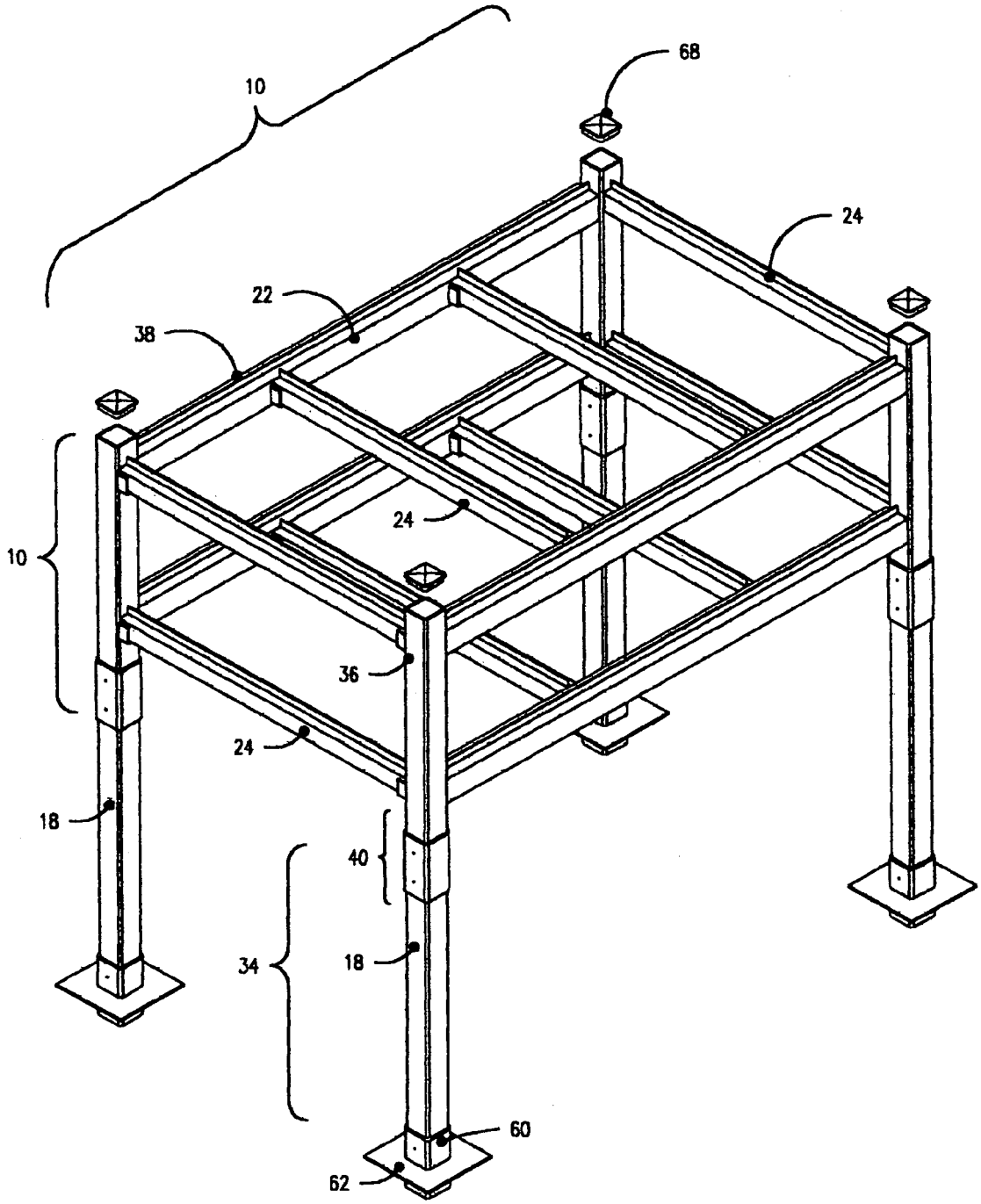
FIG. 4A is a perspective view of the rigid frame structure without the vertical and horizontal panels in place.
Figure 4B:
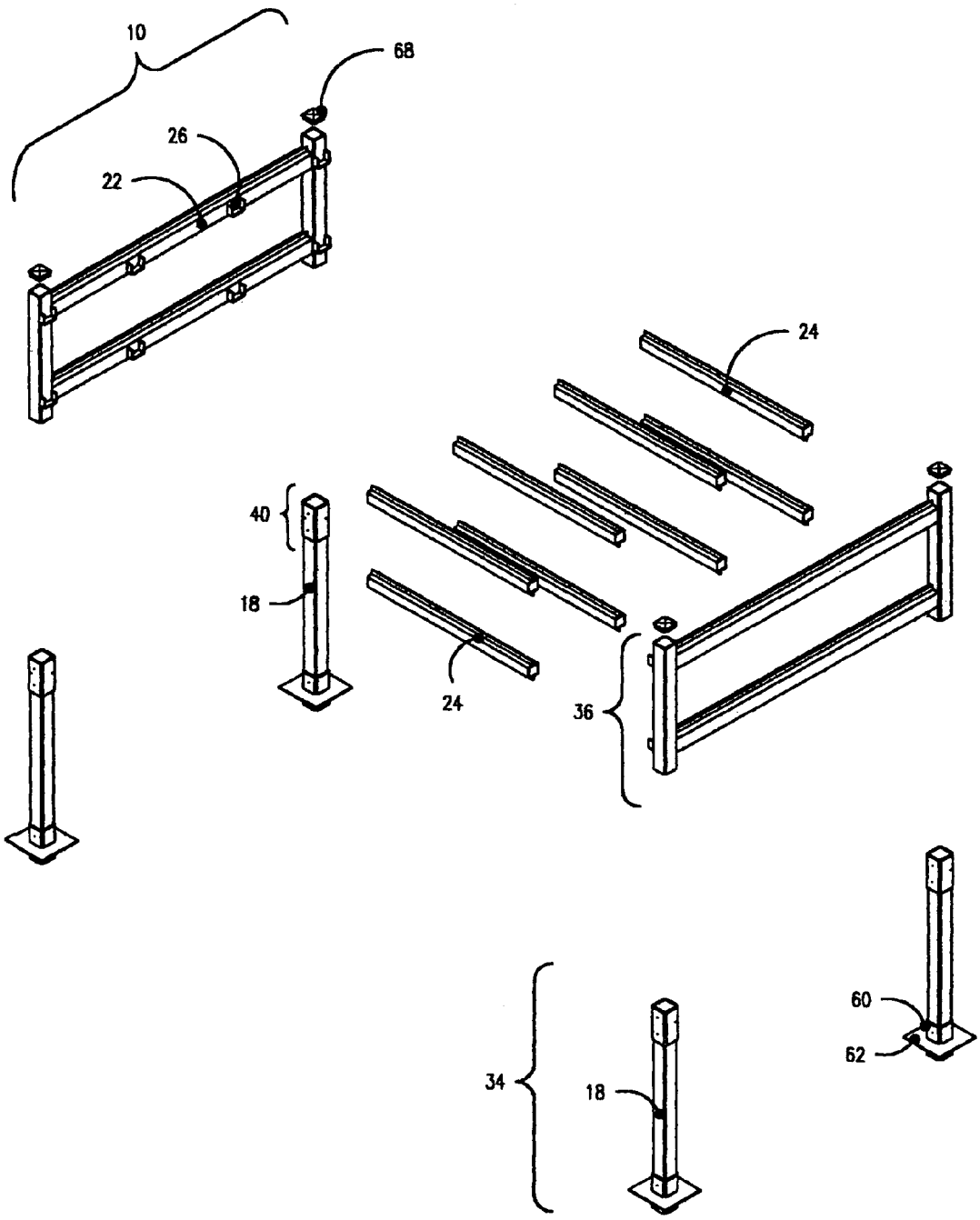
FIG. 4B is an exploded perspective view of the rigid frame structure without the vertical and horizontal panels in place.

As shown in FIGS. 2, 4A, and 4B horizontal support members 22 have U-shaped saddles 26 permanently attached to their inward faces to act as bearing and connection points for the perpendicular horizontal cross members 24. In addition, horizontal support members 22 and horizontal cross members 24 have raised vertical fins 38 permanently attached to their top and bottom surfaces. The raised vertical fins 38 serve as termination/connection points for horizontal panels 30 and vertical panels 32. The raised vertical fins 38 also restrict movement and any potential shift by defining bearing spaces for said horizontal panels 30 as well as detection equipment. The raised vertical fins 38 are formed from the same material as the horizontal support members 22 and horizontal cross members 24, and are truncated in length to allow for clearance with respect to the U-shaped saddles 26.

Figure 5:
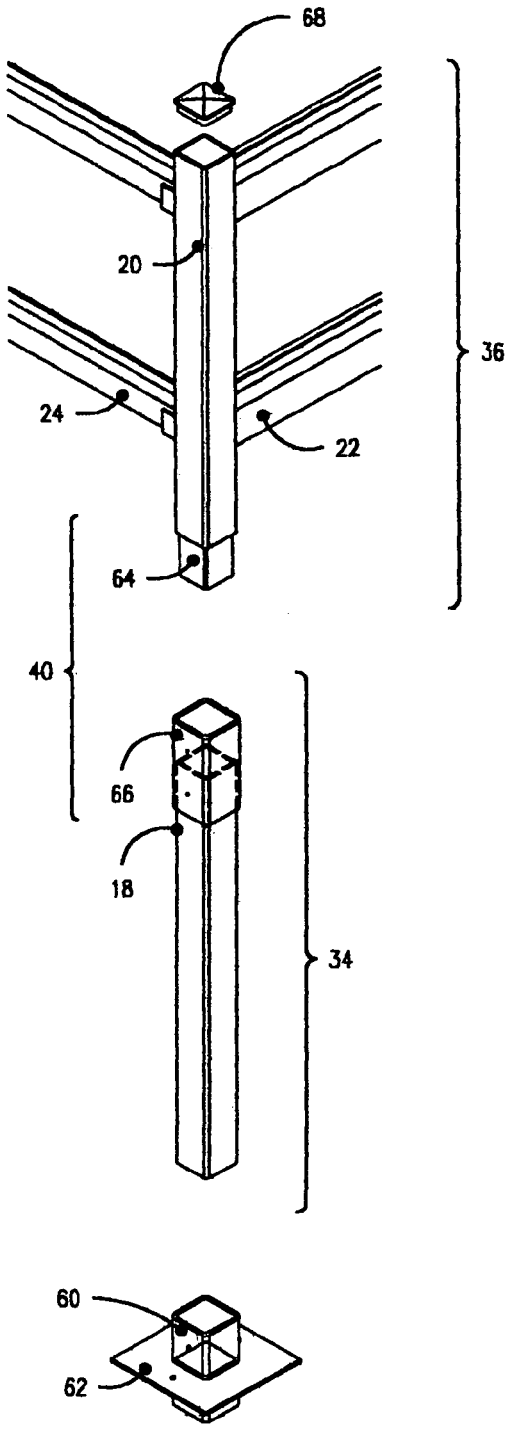
FIG. 5 is a detailed perspective view of a vertical section of the rigid frame structure showing the coupling method between the upper and lower support structure.

The rigid frame inspection structure 10 is formed from two types of major subassemblies (see FIGS. 4B and 5). The major subassemblies are the lower support structure 34, and the upper support structure 36. The lower support structure 34 is formed by lower vertical members 18 with anchor boots 60 attached to the lower vertical members 18. The anchor boot 60 has a flange 62 that is used to properly level the anchor boot, that is half sunken into raised concrete curb, then tightly fasten to both preset bolts within concrete curb and lower vertical member 18. The upper support structure 36 is formed by permanently joining upper vertical members 20 with horizontal support members 22. The upper vertical members 20 have rubber end-caps 68 that serve as protective terminations to prevent moisture penetration within the hollows of the upper vertical members.

FIG. 5 details the coupling of the lower support structures 34 and the upper support structures 36 that are joined at location 40 of FIGS. 1 and 4. An outer sleeve 66 is permanently affixed to the lower vertical member 18, while an inner sleeve 64 is permanently affixed to the inner portion of the upper vertical member 20 of the upper support structure 36. The upper support structure 36 is then lowered onto the lower support structure 34 with the inner sleeve 64 resting within the lower vertical member 18, which is then bolted to the outer sleeve 66 and the lower vertical member 18. Though the upper vertical elongate member 20 rests onto the lower vertical elongate member 18, said outer and inner sleeves, as well as mechanically fastened connections, contribute to the conveying of upper structure 36 attributable loads while achieving precise alignment; thus, denying any slip potential.

Figure 6:
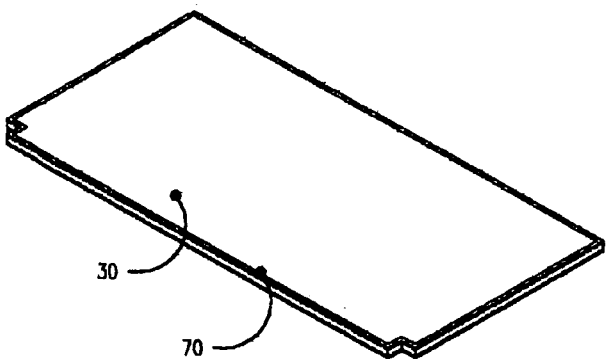
FIG. 6 is a perspective view of a typical horizontal panel for the rigid frame structure.
Figure 8:
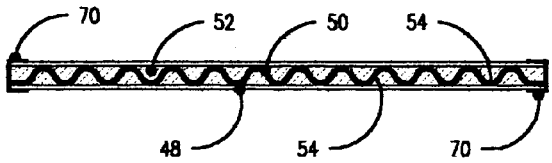
FIG. 8 is a typical cross section view of a horizontal or vertical panel illustrating the composition of corrugated construction with quick-setting rigid filler sandwiched between two sheets of uniformly thick plating.

FIG. 6 is an example of a typical horizontal panel 30 for the 'Rigi-Frame' (see FIG. 8) that consists of corrugated material 50 sandwiched between, and joined to, two sheets of uniformly thick plating 48. A filler 52 is injected into the voids between the two sheet plates 48 for added rigidity, strength, and resilience. Types of fillers 52 may include, but are not limited to, extruded polystyrene and/or quick-setting urethane based resin. An adhesive 54 binds both the corrugated material 50 and the filler 52. The sheet plates 48 and the corrugated material 50 may be made of, but not limited to, metal or other high strength composite material. Bent edging 68 with screw holes terminate the edges of the horizontal panels 30, and are used to secure the horizontal panels 30 to the raised vertical fins 38 of horizontal support members 22 and horizontal cross members 24. The bent edging may be made of, but not limited to, metal or other high strength composite material. The horizontal panels 30 are shaped to accommodate the presence of the upper vertical members 20.

Figure 7:
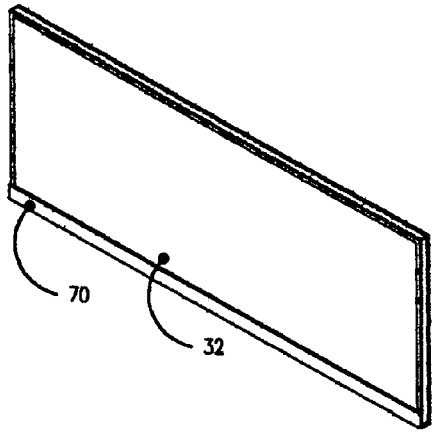
FIG. 7 is a perspective view of a vertical panel for the rigid frame structure.

FIG. 7 is an example of a vertical panel 32. The vertical panels 32 serve as the protective walls for the detection equipment (not shown) to be housed within the rigid frame inspection structure 10. The vertical panels 32 (see FIG. 8) consist of corrugated material 50 sandwiched between, and joined to, two sheets of uniformly thick plating 48. A filler 52 is injected into the voids between the two sheet plates 48 for added rigidity, strength, and resilience. Types of fillers 52 may include, but are not limited to, extruded polystyrene and/or quick-setting urethane based resin. An adhesive 54 will bind the corrugated material 50 to the filler 52. The sheet plates 48 and the corrugated material 50 may be made of, but not limited to, metal or other high strength composite material. Bent edging 68 with screw holes terminate the edges of the vertical panels 32. The bent edging 68 is used to secure the vertical panels 32 to horizontal lips 42 that protrude perpendicularly from vertical panels 32. The bent edging may be made of, but not limited to, metal or other high strength composite material. The horizontal lips 42 are used to secure the vertical panels 32 to the raised vertical fins 38 of horizontal support members 22 and horizontal cross members 24.

Figure 9:
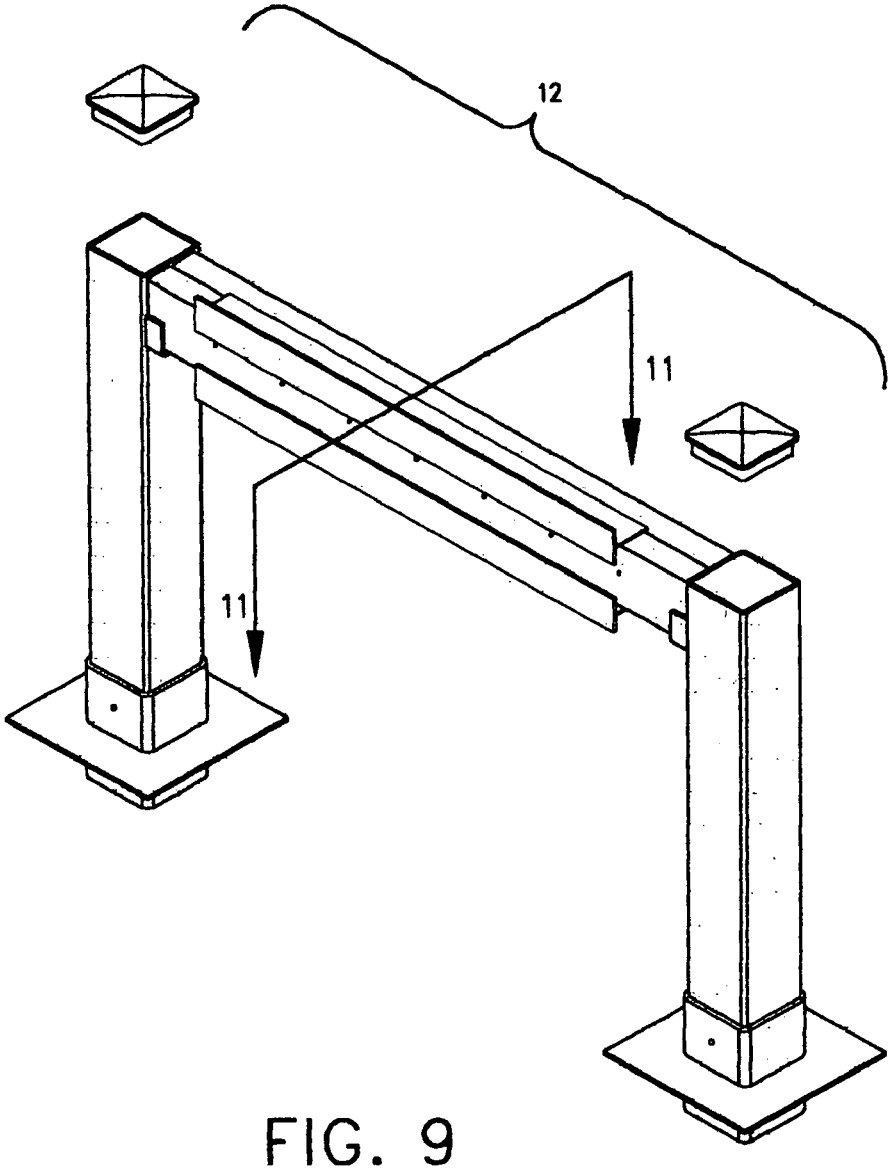
FIG. 9 is a perspective view of a crash beam assembly.

The crash beam structure 12 of FIG. 9 provides horizontal member 14 as a horizontal fixed obstacle to vehicles with vertical profiles that may exceed a desired maximum height. The crash beam structure is designed to withstand the impact of a fast moving large vehicle, including a fully loaded commercial truck.

Figure 10:
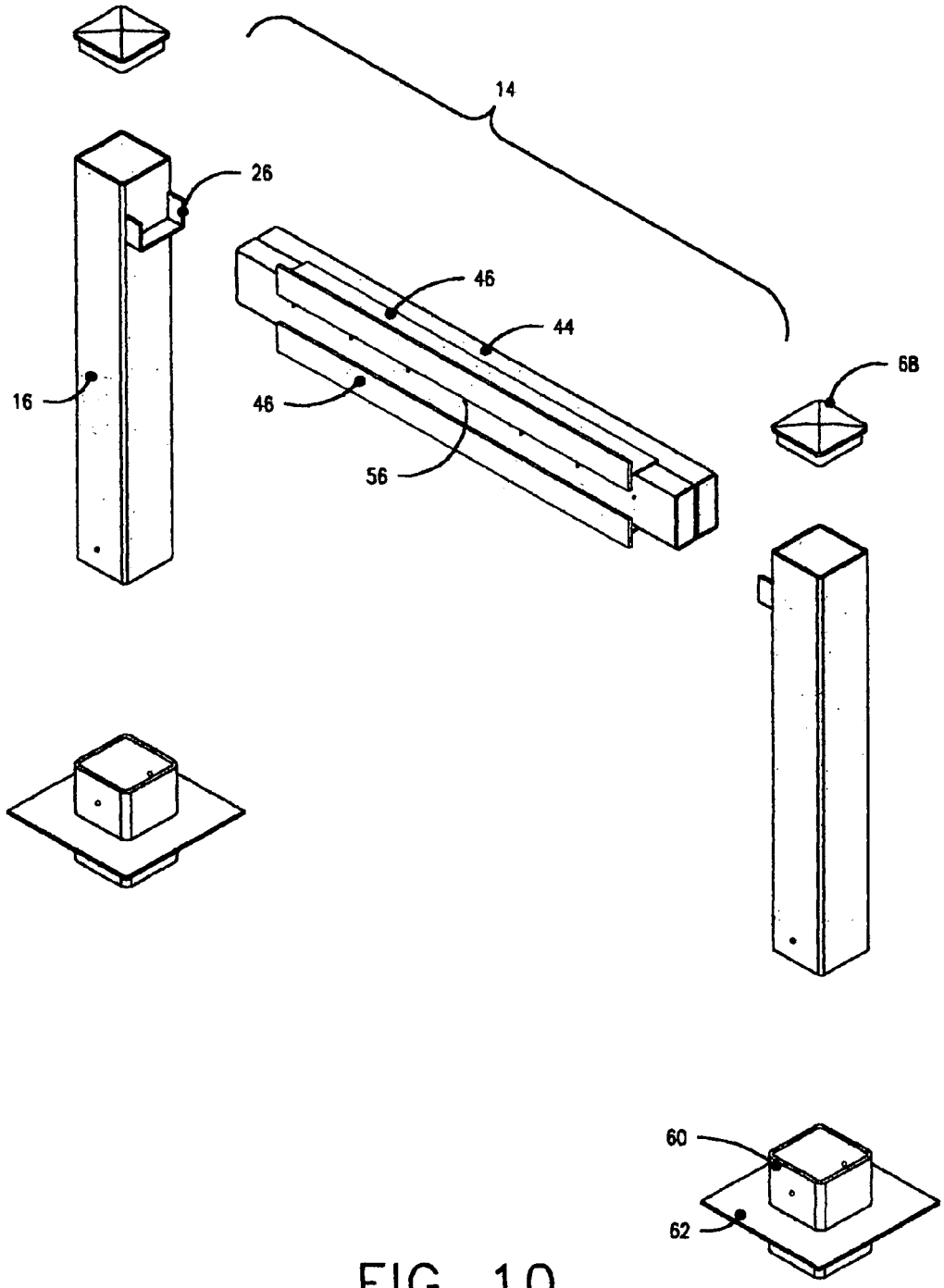
FIG. 10 is an exploded perspective view of the crash beam assembly.
Figure 11:
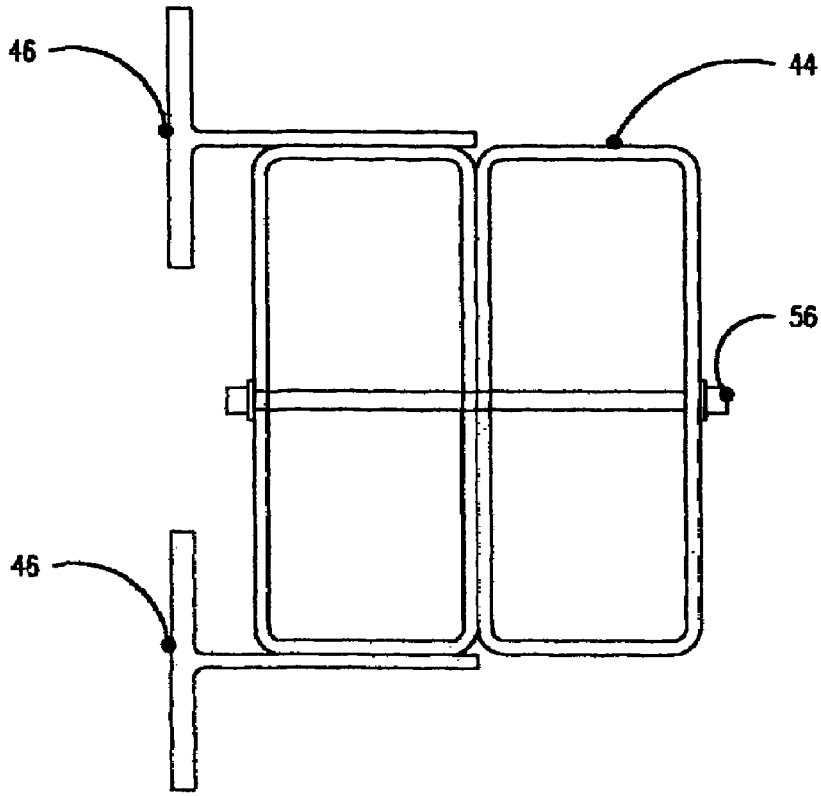
FIG. 11 is a sectional view of the horizontal member of the crash beam assembly along line 11—11 of FIG. 8.

The construction of the crash beam structure 12 is evident in FIGS. 9, 10, and 11. The crash beam structure 12 is made up of vertical members 16, and a horizontal member 14. The vertical members 16 are of an elongated tubular square design, and may be made of, but not limited to, metal or other high strength composite material. The vertical members 16 have anchor boots 60 affixed to their lower ends. The anchor boot 60 has a flange 62 that is used properly level the anchor boot that is half sunken into a raised concrete curb then fastened to preset bolts embedded into the raised concrete curb as well as the crash beam structure 12. Vertical members 16 have U-shaped saddles 26, permanently attached to their inward faces, to act as bearing and bolted connection points for the horizontal member 14.

The horizontal member 14 is made up of two bundled elongate rectangular transfer members 44, which are joined by a series of incrementally spaced tie rods 56. T-shaped horizontal impact members 46 are affixed to the upper and lower surfaces of rectangular transfer member 44. The components of the horizontal member 14 may be made of, but not limited to, metal or other high strength composite material.

Figure 3:
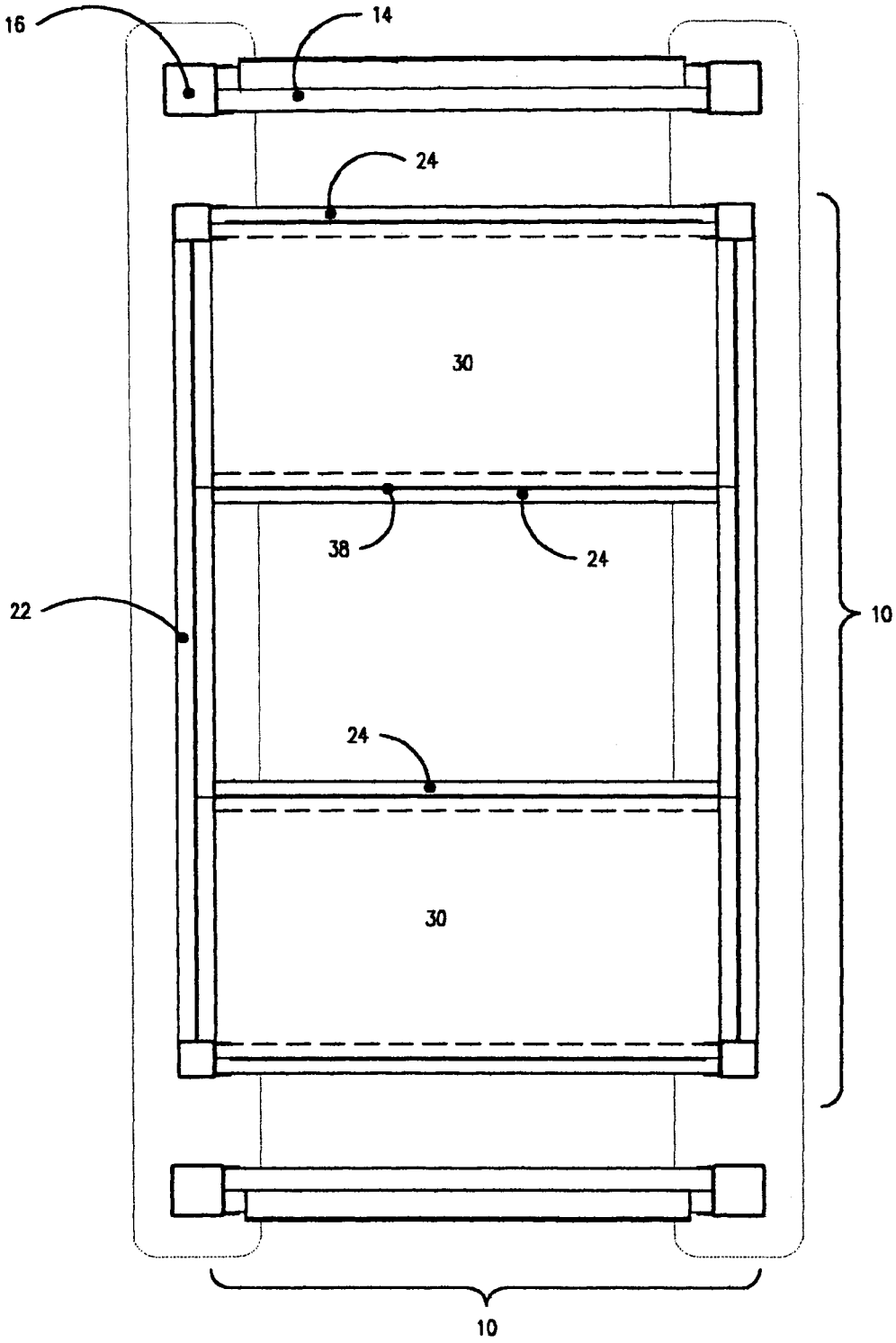
FIG. 3 is a top view of the rigid frame inspection structure with crash beams at the entry and exit of FIG. 2.

In FIGS. 2 and 3 the rigid frame inspection structure 10 and crash beam structures 12 are set into a raised concrete curb 28.

While the preferred embodiments of the invention have been disclosed in considerable detail, variations based on the inventive features disclosed herein may be made within the spirit of the invention, and the scope of the invention should not be limited by the examples or to the exact construction shown or described. To properly determine the scope of the invention, an interested party should consider the claims herein, and any equivalent thereof.

Having thus described my invention, I claim:

1. A rigid frame inspection structure for housing radiation, contagion, explosive, and other forms of detection and surveillance equipment comprising:

a plurality of elongate lower vertical members, elongate upper vertical members, elongate horizontal support members, elongate horizontal cross members, vertical panels, and horizontal panels; and said upper vertical members are permanently affixed to said horizontal support members; and wherein said horizontal support members have U-shaped saddles affixed to their inward facing surfaces; and said U-shaped saddles act as bearing connection points for said horizontal cross members, and wherein said upper vertical members are coupled to said lower vertical members by inner sleeves permanently affixed to the inner surfaces of said upper vertical members; and said inner sleeves fit into said lower vertical members; and outer sleeves are affixed over said lower vertical members and said upper vertical members; and wherein said lower vertical members have anchor boots affixed to their lower ends; and said anchor boots have flanges to secure in place said rigid frame structure.

2. The rigid frame inspection structure of claim 1 wherein said lower vertical members, said upper vertical members, said horizontal support members, and said horizontal cross members are hollow and of square cross section.

3. The rigid frame inspection structure of claim 1 wherein said lower vertical members, said upper vertical members, said horizontal support members, and said horizontal cross members are hollow and of rectangular cross section.

4. The rigid frame inspection structure of claim 1 is made of metal.

5. The rigid frame inspection structure of claim 1 is made of other high strength composite material.

6. The rigid frame inspection structure of claim 1 wherein said horizontal support members, and said horizontal cross members have vertical fins affixed to their upper and lower surfaces; and said vertical fins serve as connection points for said horizontal panels and said vertical panels; and wherein said vertical fins also serve to define location and restrict shifting of said horizontal panels and said vertical panels.

7. The rigid frame inspection structure of claim 1 wherein said horizontal panels and said vertical panels further comprise:

corrugated material, sheet plates, bent edging, adhesive, and a filler; and wherein said corrugated material is sandwiched between said sheet plates; and wherein said corrugated material is joined to said sheet plates; and wherein said adhesive is applied to the upper and lower surfaces of said corrugated material; and said filler is injected between said uniformly thick sheets of plating for added rigidity, strength, and resilience; and wherein said filler adheres to said adhesive that was applied to said corrugated material; and wherein said bent edging terminates said horizontal panels and said vertical panels;

and said bent edging serves as connection points for said horizontal panels and said vertical panels with said horizontal support members and said horizontal cross members.

8. The horizontal panels and vertical panels of claim 7 wherein said filler may be comprised of quick-setting urethane based resin.

9. The horizontal panels and vertical panels of claim 7 wherein said filler may be comprised of extruded polystyrene.

10. A crash beam structure for impeding the forward progress of vehicles comprising:

a pair of vertical members; and a horizontal member; and wherein said vertical members have U-shaped saddles affixed to their inward facing surfaces; and said U-shaped saddles act as bearing/connection points for said horizontal member, and wherein said vertical members have anchor boots affixed to their lower ends; and said anchor boots have flanges to properly level said anchor boot, which is half sunken into a substrate; a plurality of fasteners for fastening said anchor boots to said substrate and said vertical members as well as vertical members of crash beam structure.

11. The crash beam structure of claim 10 wherein said horizontal member further comprises:

A pair of elongate rectangular transfer members, tie rods, and T-shaped horizontal impact members; and said rectangular transfer members are joined by said tie rods; and wherein said tie rods are incrementally spaced along the length of said rectangular transfer members; and said T-shaped horizontal impact members are permanently affixed to the upper and lower surfaces of said bundled rectangular transfer members.

12. The crash beam structure of claim 10 wherein said vertical members are hollow and of square cross section.

13. The crash beam structure of claim 10 wherein said vertical members are hollow and of rectangular cross section.

14. The crash beam structure of claim 10 may be made of metal.

15. The crash beam structure of claim 10 may be made of other high strength composite material.

16. The crash beam structure of claim 10 wherein the height of said horizontal member determines the type of vehicle allowed to progress through said crash beam structure.

17. A system for selecting and inspecting vehicles which comprises:

a plurality of crash beam structures; and a rigid frame inspection structure a plural of elongate lower vertical members, elongate upper vertical members, elongate horizontal support members, elongate horizontal cross members, vertical panels, and horizontal panels; and anchor boots affixed to lower ends of said lower vertical members, said anchor boots having horizontal flanges to properly level said anchor boot into a substrate, and vertical flanges to fasten said anchor boot to said lower ends of said lower vertical members;

outer sleeves affixed over said upper and lower vertical members;

U-shaped saddles affixed to inward facing surfaces of said horizontal supports members, to act as bearing/connection points for said support members;

Wherein said upper vertical members are affixed to said horizontal support members;

and are coupled to said lower vertical members by inner sleeves, that are permanently affixed to inner surfaces of said upper vertical members and fit into said lower vertical members.

18. The system of claim 17 wherein said rigid frame inspection structure houses surveillance and detection equipment.

* * * * *